United States Patent [19]

Mouri et al.

[11] Patent Number: 4,868,581

[45] Date of Patent: Sep. 19, 1989

[54] INK-RECEIVING COMPOSITE POLYMER MATERIAL

[75] Inventors: Hidemasa Mouri; Michiaki Tobita, both of the Yokohama; Naonobu Eto, Yamato; Masahiko Ishida, Fujisawa; Shunzo Kouno, Yokosuka; Takashi Akiya, Yokohama; Shigeo Toganoh; Masahiko Higuma, both of Tokyo; Mamoru Sakaki, Hiratsuka; Ryuichi Arai, Sagamihara, all of Japan

[73] Assignee: Cannon Kabushiki Kaisha, Tokyo, Japan

[21] Appl. No.: 942,792

[22] Filed: Dec. 17, 1986

[30] Foreign Application Priority Data

Dec. 20, 1985 [JP] Japan ..... 60-285742
Dec. 27, 1985 [JP] Japan ..... 60-292824

[51] Int. Cl.[4] ..... B41M 5/00

[52] U.S. Cl. ..... 346/1.1; 346/135.1; 427/256; 427/261; 428/195; 428/211; 428/334; 428/335; 428/336; 428/480; 428/514; 428/522; 428/532; 428/535

[58] Field of Search ..... 428/321.3, 195, 211, 428/537.5, 334–336, 480, 514, 522, 532, 535; 346/135.1, 1.1; 427/261, 256

[56] References Cited

U.S. PATENT DOCUMENTS 4,153,593 5/1979 Zabiak et al. ..... 524/376
4,371,582 2/1983 Sugiyama et al. ..... 428/341
4,474,847 10/1984 Schroder et al. ..... 428/323

*Primary Examiner*—Ellis P. Robinson
*Assistant Examiner*—P. R. Schwartz
*Attorney, Agent, or Firm*—Fitzpatrick, Cella, Harper & Scinto

[57] ABSTRACT

There are disclosed an ink-receiving composite polymer material wherein a nonvolatile organic compound is caused to penetrate into and diffuse through an ink-receiving polymer forming, from any one surface side thereof, and a recording medium for ink-jet recording wherein a nonvolatile organic compound is caused to penetrate into and diffuse through an ink-receiving layer, from the surface thereof.

8 Claims, 1 Drawing Sheet

INK-RECEIVING COMPOSITE POLYMER MATERIAL

BACKGROUND OF THE INVENTION

1. Field of the Invention

The present invention relates to an ink-receiving composite polymer material, particularly to a composite polymer which is useful as recording media for ink-jet recording.

2. Related Background Art

Various polymer materials comprising one or a plurality of components are conventionally known. Composite polymer materials comprising a plurality of components include materials in which these components are uniformly distributed over the whole of the resultant polymer formation and materials which exhibit a component gradient within the resultant polymer formation.

Examples of materials having component gradients include the following:

(1) materials comprising one or more polymer films laminated on a polymer substrate;

(2) materials obtained by applying one or more polymer solutions to a polymer substrate so as to form layers;

(3) materials in which monomers or oligomers are mixed and, during the polymerization thereof, the composition of an unreacted system is gradually changed, resulting in a component gradient through the whole of the resultant polymer formation; and (4) materials in which two or more kinds of monomers and/or polymers are mixed and a polymer formation having a sea-island structure is obtained by controlling the solubilities in a solvent or the compatibilities of the polymers to one another.

These sorts of composite polymer materials have been employed for various applications, particularly for materials relating to printing, adhesives, and structural materials, for a long time. These polymer materials have recently been employed for lenses with varying refractive indexes and optical elements such as optical wave guides.

Recently to produce recording media for various types of printer, one or a plurality of recording layers (ink-receiving layers) has been formed on the surface of paper or a plastic film as a substrate, using various polymer solutions, for the purpose of improving the suitability of such media for recording.

In polymer formations obtained by the above-described methods (1) or (2), the component gradient exhibits a plurality of layers and so, there interfaces between the layers. The presence of these interfaces prevents continuous progresses of energy during the propagation of optical or vibrational energy through the polymer forming, so that an energy loss is likely to occur. In addition, a similar problem is produced by the discontinuity of the interfaces during the passage of light as well as substances such as molecules or ions. The presence of the interfaces also produces a physical problem in that ply separation can easily occur.

In the case of the polymer formations by the above-mentioned method (3), since the materials which penetrate thereinto and are diffused therethrough are monomers and oligomers, a process of reaction and polymerization is necessary to fix these materials, and thus there are problems with respect to the difficulty in controlling the component gradient, the reproducibility of materials, and the difficulty in the production of composite polymer formations having uniform quality.

In the case of the polymer formations by the above-mentioned method (4), since the component gradient is formed by differences in solubility and compatibility, the component gradient is random, and it is impossible to obtain uniform component gradients.

When the polymer formations by the above-mentioned method (2) are used as, for example, recording media for the ink-jet recording method using an aqueous ink, there are problems relating to the absorption of ink in that it is difficult to control ink absorbency, the ink diffuses into the interfaces between the layers, and is prevented from being absorbed, and problems with respect to adhesion and ply separation due to poor adhesion properties.

SUMMARY OF THE INVENTION

Therefore, it is an object of the present invention to solve the problems in conventionally known composite polymer formations having component gradients.

It is another object of the present invention to provide a composite polymer material which exhibits an excellent surface strength of an ink-receiving layer and excellent adhesion properties, no stickiness of surfaces and printings, and excellent ink absorbency, which produces no ply separation and which is useful as a recording medium for ink-jet recording.

According to one aspect of the present invention, there is provided an ink-receiving composite polymer material wherein a nonvolatile organic compound is caused to penetrate into and diffuse through an ink-receiving polymer formation, from any surface thereof.

According to another aspect of the present invention, there is provided a recording medium wherein a nonvolatile organic compound is caused to penetrate into and diffuse through an ink-receiving layer from the surface thereof.

DETAILED DESCRIPTION OF THE PREFERRED EMBODIMENTS

Figure 1:
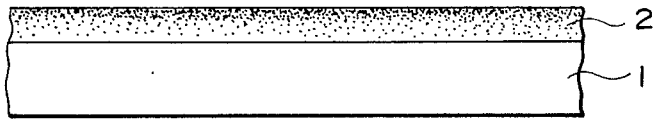
FIG. 1 illustrates a schematically sectional view of the ink-receiving composite polymer material of the present invention.

The ink-receiving polymer formations used in the present invention may be conventional ink-receiving polymer formations or may comprise various different polymer layers formed on the surface of a substrate made of metal, glass, paper or the like. These layers may be formed by laminating films or by coating polymer solutions and then drying them.

Preferred materials for forming such polymer layers include, for example, natural water-soluble hydrophilic resins such as albumin, gelatin, casein, starch, cationic starch, gum arabic, sodium alginate, etc., and synthetic water-soluble hydrophilic resins such as polyvinyl alcohol, polyamide, polyacrylamide, quaternary polyvinyl pyrrolidone, polyethylene imine, polyvinyl pyridium halide, melamine resins, polyurethane, polyester, a sodium salt of polyacrylic acid, phenol resins, and alkyd resins.

In addition to the above-described thermoplastic resins, it is possible to use hydrophobic resins such as styrene-butadiene rubbers, acrylonitrile-butadiene rubbers, polyvinyl formal, polymethyl methacrylate, polyvinyl butyral, polyacrylonitrile, polyvinyl chloride, polyvinyl acetate, etc.

These polymer materials can include various kinds of fillers, for example, inorganic and organic fillers such as silica, clay, talc, diatomite, calcium carbonate, calcium sulfate, barium sulfate, aluminum silicate, synthetic zeolite, alumina, zinc oxide, lithopone, satin white, fluorine plastic particles, polyolefin resin particles, etc., depending upon use application of the polymer materials.

The polymer layers comprising the materials described above may have any thickness, but when the object is to obtain a recording medium, the polymer layers preferably have a thickness of 1 to 200 μm, in particular about 3 to 100 μm. Of course the particular thickness of the layers depends upon the intended object and is not limited to the above-described range.

In the present invention, the nonvolatile organic compounds which are to penetrate into and diffuse through the above-described polymer formations include those compounds which do not produce, for example, volatilization, bleeding, or migration after they have penetrated and diffused, or if such a movement of the compounds as above-described can be prevented by some means after the penetration and diffusion has occurred, compounds which are themselves volatile or produce bleeding may be used.

A typical example is a monomer for forming a polymer, an oligomer, or an organic substance having a medium molecular weight. Such a monomer or oligomer may be one conventionally known one, and a method of fixing the organic compound in a polymer forming after it has penetrated thereinto and diffused therethrough may be a conventionally known method such as polymerization or crosslinking of the monomer or oligomer.

Other typical preferred examples include various polymers such as conventionally known thermoplastic polymers, water-soluble polymers, and hydrophobic polymers, as described above.

The composite polymer materials of the present invention can be obtained by allowing the above-described nonvolatile organic compounds to penetrate into and to diffuse through the above-described polymer formations. It is an important point that the nonvolatile organic compounds differ from the polymer formations into which the compounds are to penetrate and diffuse with respect to their physical properties such as molecular weight, specific gravity, Young's modulus, conductivity, permittivity, solubility, etc., and that the polymer formations have a component gradient in a certain direction, for example, the direction of thickness.

A preferable method for the penetration and diffusion is a method in which a polymer formation is soaked in solution or in which a solution is applied to a polymer formation, using a solution prepared by dissolving a nonvolatile organic compound (which is to penetrate into and diffuse through the polymer formation) in a suitable solvent that is capable of partially dissolving or swelling the polymer forming without excessively dissolving it.

By this method, (and, if necessary, heating) the polymer forming is swelled and the nonvolatile organic compound together with the solvent penetrates and diffuses through intermolecular voids produced by the swelling. During this time, it is possible to change the speed of penetration and diffusion by changing conditions such as the temperature or the time taken, to change the degree of penetration and diffusion of the nonvolatile organic compound through the polymer formation at will.

Such penetration and diffusion ensures that the concentration of the nonvolatile organic compound which has penetrated into and diffused through the polymer formation increases towards the surface of the polymer formation and decreases with increasing distance from the surface, so that it is possible to give the polymer formation a component gradient and thus obtain the composite polymer material of the present invention. This component gradient can be changed by changing the above-described conditions such as temperature and time, as well as the kinds and combination of solvents used.

Any hydrophilic solvent such as water, alcohol, ketone, ester, amide, etc., or any hydrophobic solvent such as an aromatic hydrocarbon, etc. may be used as the solvent used for penetration and diffusion. A suitable solvent (including a mixture of solvents) is selected for use in accordance with the combination of the polymer formation into which the organic compound is to penetrate and diffuse, with the nonvolatile organic compound which is to penetrate thereinto and diffuse therethrough.

For example, when a particular nonvolatile organic compound is to penetrate into and diffuse through a particular polymer formation, it is necessary to select a solvent which is able to dissolve a certain polymer formation to some extent (a solvent having a very strong dissolving ability is not preferable because it will damage the polymer formation), and preferably is able to sufficiently swell the polymer formation, and which sufficiently dissolves the nonvolatile organic compound. A solvent having such abilities can be easily provided by a suitable selection thereof or a suitable combination of two or more kinds of solvents.

The present invention is described in more detail below with reference to typical applications of the composite polymer materials of the present invention.

The embodiment illustrated in FIG. 1 is a recording medium for ink-jet recording which comprises a substrate 1 with an ink-receiving layer 2 provided thereon. The present invention is applied to the ink-receiving layer 4 which comprises two or more kinds of polymers and is characterized in that these two or more polymers are not formed as layers but are formed so as to have a continuous component gradient.

In a particularly preferred embodiment, a polymer having a high degree of ink-absorbency is used for forming the ink-receiving layer, and a polymer having an excellent resistance to blocking and resistance to sticking in printing is selected as a penetrating-diffusing polymer, so that it is possible to provide a high-quality recording medium for ink-jet recording which has excellent ink absorbency, excellent adhesion properties of its ink-receiving layer with respect to the substrate, and which produces no blocking or sticking in printing.

Since an ink-jet recording method generally employs an aqueous ink, as the polymer used for forming the ink-receiving layer, it is preferable to use a polymer having good ink absorbency with respect to an aqueous ink, for example, one of the water-soluble or hydrophilic polymers in the above-described polymers. As the polymer which is made to penetrate into and diffuse through the ink-receiving layer, it is preferable to select and use a polymer having a large physical strength, excellent resistances to blocking, and sticking, and excellent adhesion properties.

Since the ink-jet recording methods have mainly employed an aqueous ink heretofore, it is necessary to use a polymer which has a high water solubility or a strong hydrophilic property for forming the ink-receiving layer. However, when the ink-receiving layer is formed from such a polymer having a high water solubility or a strong hydrophilic property, there are problems that blocking of the recording media to each other under conditions of high humidity occurs, and that the ink-receiving layer is partially dissolved in the aqueous ink applied to the printing and thus exhibits remarkable sticking.

As a way for solving such problems, it has been through that the ink-receiving layer is formed into a multi-layer structure by forming an ink-penetrating layer, a blocking prevention layer, a sticking prevention layer, etc. However there are problems that since such a sticking prevention layer is necessary to be formed from a material having low water solubility and a poor hydrophilic property, the ink absorbency of the ink-receiving layer is inevitably decreased and that an aqueous ink extends over interfaces between these layers and the adhesion properties are thus deteriorated.

While in the above-described embodiment of the present invention, the ink-receiving layer is formed using such a polymer (e.g. polyvinylpyrrolidone, polyvinylalcohol, etc.) that exhibits high water solubility or a good hydrophilic property, and excellent ink-absorbency, but that cannot be used for forming the ink-receiving layer because, when it alone is used for forming such an ink-receiving layer, the above-mentioned problems are produced. Since a polymer having low ink-absorbency, the resistance to blocking and sticking, and a high strength of coating, for example, a cellulose derivative, starch and derivatives thereof, polyvinylalcohol and derivatives thereof, polyacrylic acid and derivatives thereof, polyester and derivatives thereof, alkyd resin and derivatives thereof, butyral resin and derivatives thereof, polymethacrylic acid and derivatives thereof and the like, penetrates into and diffuses through the ink-receiving layer from the surface thereof so that the concentration of the cellulose derivative is high on the surface of the ink-receiving layer and the concentration decreases with an increasing distance from the surface, no problem with respect to the blocking and sticking properties and water resistance in printing is produced while maintaining excellent ink-absorbency of the polymer used for forming the ink-receiving layer. Additionally, the ink-receiving layer formed in such a manner is a single layer and the problem with respect to ply separation caused by the diffusion of the aqueous ink between the layers is thus solved.

A method of obtaining such recording media is one in which a solution or a dispersion of a polymer material is applied to a suitable substrate such as a sheet of paper or a plastic film by a conventionally known method, for example, by means of an air doctor coater, a blade coater, a knife coater, a rod coater, a direct coater, a reverse coater, a gravue coater, or curtain coater, and is dried to form a layer, and a solution produced by dissolving a polymer used for the penetration and diffusion in a solvent selected on the basis of the above description is applied to the layer formed in a similar manner and dried after the polymer has penetrated into and diffused through the layer.

Although the present invention is described hereinabove with reference to the preferred embodiments thereof, the invention is not limited to them and is capable of providing composite polymer materials suitable for various applications by suitably combining polymer formings, nonvolatile organic compounds for the penetration and diffusion, and solvents.

The present invention described above shows the following various functional effects:

(1) A nonvolatile organic compound, for example, a different polymer from that used for forming a polymer formation, is to penetrate into and diffuse through the polymer formation after the polymer formation has been formed from a desired polymer so that the form of the polymer formation is not limited, and a desired component gradient which is formed in the polymer formation can be easily achieved by selecting a suitable polymer for the penetration and diffusion, solvent, the concentration thereof, or penetration and diffusion conditions such as temperature and time.

(2) The penetration and diffusion of the nonvolatile organic compound can be effected more than once and so it is thus possible to provide a composite polymer material having a higher quality by selective and combining the nonvolatile organic compounds which are to penetrate and diffuse.

(3) The composite polymer material of the present invention has no unnecessary interface therein and thus, no discontinuous change occurs during the transmission or penetration of a substance or energy, and no problem with respect to the adhesion properties between the layers produces by the same reason.

4) Natural resins which are not monomers or oligomers can be used as the nonvolatile organic compound for the penetration into and diffusion through the composite polymer materials of the present invention.

(5) The nonvolatile organic compound can penetrate into and diffuse through the polymer formation at a pattern state and it is thus possible to provide an optical element having a complex function.

The present invention is further described in detail below by way of examples, a comparison examples, and an application example, wherein the term of "parts" or "%" is based by weight unless a particular description is otherwise made.

EXAMPLE 1

The following composition A was applied onto a polyester film having a thickness of 100 μm as a substrate so that the thickness of a film becomes 20 μm, and hardened by drying at 140° C. for 30 min. to form a filmy polymer forming on the substrate.

| Composition A | |
|---|---|
| Polyvinylmethylether-maleic acid copolymer (trade name, Gantrez AN-139, produced by GAF) | 20 parts |
| Sorbitol polyglycidyl ether (trade name, DENACOL EX-614B, produced by Nagase Industry Co., Ltd.) | 5 parts |
| Ethanol | 75 parts |

The following composition B as an agent for penetration and diffusion was then applied so that the penetrating and diffusing amount of the composition B may become 0.8 g/m$^2$, and was subjected to penetration and diffusion at room temperature for 5 minutes. Then the remaining solvent was removed by heating at 80° C. for 15 min. to obtain the ink-receiving composite polymer materials of the present invention.

| Composition B | |
|---|---|
| Styreneacrylate resin (trade name, Oxylac SH-2210, produced by Nippon Catalytic Chemistry Co., Ltd.) | 10 parts |
| Ethyl Cellosolve | 90 parts |

EXAMPLE 2

88 parts of an dimethylformamide (hereinafter referred to as DMF) solution of 10% polyvinyl pyrrolidone (PVPK-90, produced by GAF) and 12 parts of a DMF solution of 10% novolac phenol resin (Resitop PSK-2320, produced by Gunei Chemical Co., Ltd.) were mixed and used as a composition C.

A polyester film having a thickness of 100 μm (produced by Toray Industries Co., Ltd.) was used as a light transmission substrate and the composition C having the above composition was coated on this film by a bar coater method so that the thickness may become 8 μm after drying and then dried at 100° C. for min. to form a polymer layer. The following composition D as an agent for penetration and diffusion was then applied onto the polymer layer formed so that the amount of the composition D may become 0.8 g/m$^2$ after penetrating, diffusing and drying and allowed to stand at room temperature for 10 min. so as to penetrate into and diffuses through the layer. The remaining solvent was then removed by heating at 80° C. for 5 min. to obtain a composite polymer material of the present invention of a recording medium type.

| Composition D | |
|---|---|
| Hydroxyethyl cellulose (trade name, HEC AH-15, produced by Fuji Chemical Co., Ltd.) | 5 parts |
| Water/ethanol (4/1) | 95 parts |

EXAMPLE 3

The following composition E was applied onto an art paper (trade name, OK art, produced by Oji Paper Co., Ltd.) as a substrate so that the thickness of a dried film may become 10 μm and dried at 140° C. for 5 min. to form a polymer layer.

| Composition E | |
|---|---|
| Polyvinylpyrrolidone (trade name, PVP K-90, produced by GAF) | 7 parts |
| Methylvinylether-maleic anhydride monoethyl ester copolymer (trade name, GANTRES, ES-425, produced by GAF) | 3 parts |
| Dimethylformamide (DMF) | 90 parts |

The following composition F as an agent for penetration and diffusion was then applied onto the polymer layer so that the amount of the composition F may become 1.5 g/m$^2$ after penetrating, diffusing and drying, and was subjected to penetration and diffusion at room temperature for 3 min. The remaining solvent was thereafter removed by heating at 110° C. for 2 minutes to obtain the ink-receiving composite polymer materials of the present invention.

| Composition F | |
|---|---|
| Oxized Starch (produced by Ajinomoto Co., Ltd.) | 5 parts |
| Water | 95 parts |

EXAMPLE 4

The following composition G was applied onto a synthetic paper (trade name, UPO, produced by Oji Upo Co., Ltd.) as a substrate so that the thickness of a dried film may become 6 μm, and dried at 140° C. for 5 min. to form a polymer layer.

| Composition G | |
|---|---|
| Polyvinylpyrrolidone (trade name, PVP K-60, produced by GAF) | 8 parts |
| Phenol resin of novolac type (trade name, RESITOP PSF-4261) | 2 parts |
| Dimethylformamide (DMF) | 90 parts |

The following composition H as an agent for penetration and diffusion was then applied onto the polymer layer so that the amount of the composition H may become 0.2 g/m$^2$ after penetrating, diffusing and drying, and was subjected to penetration and diffusion at room temperature for 5 min. The remaining solvent was thereafter removed by heating at 80° C. for 3 min. to obtain the ink-receiving composite polymer materials.

| Composition H | |
|---|---|
| Polyvinyl alcohol (trade name, PVA-217, produced by Kuraray Co., Ltd.) | 5 parts |
| Water | 95 parts |

EXAMPLE 5

The following composition I was applied onto a polyester film of 100 μm thick as a substrate so that the thickness a dried film may become 50 μm, and dried at 110° C. for 60 min. to form a filmy polymer forming on the substrate.

| Composition I | |
|---|---|
| A copolymer of vinylpyrrolidone and dimethylaminoethyl methacrylate (trade name, COPOLYMER 845, produced by GAF) | 9.5 parts |
| Tannic acid (regent grade) | 0.5 parts |
| DMF/water | 90 parts |

The following composition J as an agent for penetration and diffusion was then applied so that the penetrating and diffusing amount of the composition J may become 0.2 g/m$^2$, and was subjected to penetration and diffusion at room temperature for 1 min. Then, the remaining solvent was removed by heating at 100° C. for 2 min., followed by separating the resulting polymer forming from the polyester film to obtain the ink-receiving composite polymer materials of the present invention.

| Composition J | |
|---|---|
| Hydroxyethylcellulose (trade name, HEC AG-15, produced by Fuji Chemical) | 2 parts |
| Water | 98 parts |

COMPARISON EXAMPLE 1

A recording medium for comparison was obtained a similar manner to Example 2, except that the composition D did not penetrate and diffuse.

Application Example

Ink-jet recording was conducted for the recording media of the above-described examples and a comparison example by using four kinds of inks described below by means of an ink-jet recording apparatus using a piezoelectroc oscillator.

| | |
|---|---|
| Yellow ink (composition) | |
| C.I. direct yellow 86 | 3 parts |
| Diethylene glycol | 10 parts |
| Polyethylene glycol #200 | 10 parts |
| Water | 80 parts |
| Red ink (composition) | |
| C.I. acid red 35 | 3 parts |
| Diethylene glycol | 10 parts |
| Polyethylene glycol #200 | 10 parts |
| Water | 80 parts |
| Blue ink (composition) | |
| C.I. direct blue 86 | 2 parts |
| Diethylene glycol | 10 parts |
| Polyethylene glycol #200 | 10 parts |
| Water | 80 parts |
| Black ink (composition) | |
| C.I. food black 2 | 4 parts |
| Diethylene glycol | 10 parts |
| Polyethylene glycol #200 | 10 parts |
| Water | 80 parts |

The evaluation results are shown in Table 1.

The measurements with respect to the evaluative items shown in Table 1 were performed in accordance with the following methods:

(1) An ink fixing time was measured as a time until, after recording has been conducted and a recording medium was allowed to stand at room temperature (20° C., 65% RH), an ink was dried and not adhered to fingers when a recording image was in contact with fingers.

(2) With respect to a blocking property, a sheet of wood free paper was made to contact with a printing after 1 hour from the printing and preserved for 12 hours. In the table, o denotes a recording medium which produced no blocking between the recording medium and the wood free paper and x denotes one which produced blocking after the preservation.

TABLE 1

| | Example | | | | | Comparison Example 1 |
|---|---|---|---|---|---|---|
| | 1 | 2 | 3 | 4 | 5 | |
| Ink fixing time | 5 min. | 1 min. | 1 min. | 3 min. | 1 min. | 3 min. |

TABLE 1-continued

| | Example | | | | | Comparison Example 1 |
|---|---|---|---|---|---|---|
| | 1 | 2 | 3 | 4 | 5 | |
| Blocking | o | o | o | o | o | x |

What is claimed is:

1. An ink-jet recording method comprising the steps of impinging a water-based ink on a recording medium for ink-jet recording, said recording medium comprising an ink-receiving layer containing an ink-receiving polymer and a nonvolatile organic compound having at least one property selected from the group consisting of molecule weight, specific gravity, Young's modulus, conductivity, permittivity and solubility which differs from the ink-receiving polymer, the concentration of said nonvolatile organic compound continuously varying in the direction of a thickness of said ink-receiving layer.

2. An ink-jet recording method according to claim 1, wherein said ink-receiving polymer comprises a hydrophilic or water-soluble polymer.

3. An ink-jet recording method according to claim 1, wherein said nonvolatile organic compound is selected from the group consisting of cellulose derivatives, starch and derivatives thereof, polyvinyl alcohol and derivatives thereof, polyacrylc acid and derivatives thereof, polyester and derivatives thereof, alkyd resin and derivatives thereof, polymethacrylic acid and derivatives thereof, and butyral resin and derivatives thereof.

4. An ink-jet recording method according to claim 1, wherein said ink-receiving layer has film thickness of 1 to 200 μm.

5. An ink-jet recording method for producing a color image comprising the steps of impinging water-based inks of a plurality of colors on a recording medium for ink-jet recording, said recording medium comprising an ink-receiving layer containing an ink-receiving polymer and a non-volatile organic compound having at least one property selected from the group consisting of molecular weight, specific gravity, Young's Modulus, conductivity, permittivity and solubility which differs from the ink-receiving polymer, the concentration of said non-volatile organic compound continuously varying in the direction of a thickness of said ink-receiving layer.

6. An ink-jet recording method according to claim 5, wherein said ink-receiving polymer comprises a hydrophilic or water-soluble polymer.

7. An ink-jet recording method according to claim 5, wherein said non-volatile organic compound is selected from the group consisting of cellulose derivatives, starch and derivatives thereof, polyvinyl alcohol and derivatives thereof, polyacrylic acid and derivatives thereof, polyester and derivatives thereof, alkyd resin and derivatives thereof, polymethacrylic acid and derivatives thereof, and butyral resin and derivatives thereof.

8. An ink-jet recording method according to claim 5, wherein said ink-receiving layer has a film thickness of 1 to 200μ.

* * * * *